US006257454B1

(12) United States Patent
Ritsche

(10) Patent No.: US 6,257,454 B1
(45) Date of Patent: Jul. 10, 2001

(54) MEDIA DISPENSER

(75) Inventor: Stefan Ritsche, Radolfzell (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/300,887

(22) Filed: Apr. 28, 1999

(30) Foreign Application Priority Data

May 2, 1998 (DE) ..... 198 19 748

(51) Int. Cl.[7] ..... B67B 5/00
(52) U.S. Cl. ..... 222/153.13; 222/320; 222/321.6
(58) Field of Search ..... 222/153.13, 153.11, 222/319, 320, 321.6, 384, 402.11

(56) References Cited

U.S. PATENT DOCUMENTS

| | | | | |
|---|---|---|---|---|
| 3,828,982 | * | 8/1974 | Steigerwald . | |
| 4,203,534 | | 5/1980 | Mar | 222/153 |
| 4,384,660 | * | 5/1983 | Palmisano et al. . | |
| 4,582,228 | | 4/1986 | Diamond et al. | 222/153 |
| 4,934,568 | * | 6/1990 | Fuchs . | |
| 5,282,551 | | 2/1994 | Pierson | 222/153 |
| 5,427,280 | | 6/1995 | Fuchs | 222/320 |
| 5,813,570 | | 9/1998 | Fuchs et al. | 222/82 |

FOREIGN PATENT DOCUMENTS

| | | |
|---|---|---|
| 3706963 A1 | 3/1987 | (DE) . |
| 3927708 A1 | 8/1989 | (DE) . |
| 4400605 A1 | 1/1994 | (DE) . |

* cited by examiner

*Primary Examiner*—Kevin Shaver
*Assistant Examiner*—Thach H Bui
(74) *Attorney, Agent, or Firm*—Quarles & Brady LLP

(57) ABSTRACT

The outlet (12) of a dispenser reservoir (8) is sealingly closed by a transverse catch member (21) which also positively prevents the dispenser (1) from being actuated. Pulling out the catch member (21) opens the reservoir (8) and releases the discharge actuator (37). Thus the piston (14) opposing the reservoir outlet (12) can enter. The materials of the reservoir (8) and reservoir seal (30) are paired in glass, tetrafluoroethylene or the like. Thus even sensitive media may be stored in the dispenser (1) over lengthy periods without risking any change in the substances.

35 Claims, 3 Drawing Sheets

1
2
3
4
5
6
7
8
10
11
14
15
18
21
27
29
30
32
33
34
36
38
39
41
42
43
47
48
49
51
52
55
56
57
58
59
60
61
62
63
64

MEDIA DISPENSER

TECHNICAL FIELD AND BACKGROUND OF THE INVENTION

The invention relates to a dispenser for media. These are particularly liquid, but may also be or contain a paste, a powder, a gas or the like. Thus the media are flowable or trickling or non-flowable. The dispenser is held and actuated single-handedly. All or almost all components, particularly the exposed components, are injection-molded or made from plastics.

The dispenser may resuck medium from a reservoir during a working or stroke cycle or may contain, in a separate reservoir chamber, serval premeasured doses of the medium to be discharged in sequence. Preferably the dispenser is made for a single unidirectional stroke or medium discharge and then emptied. To prevent aging, chemical change or contamination of the medium the reservoir chamber is closed, not only tightly against the presence of germicides but also the medium is maintained in contact with only materials which avoid either chemical reactions with the medium or a physical change by contact with the medium. This is difficult to achieve with usual thermoplastic or other plastics materials such as polythene or with elastomers such as rubber, chlorinated or bromobutyl rubber.

The dispenser may be accidentally actuated by external forces when prevented from actuation merely by friction, e.g. by a catch. This applies irrespective of whether the reservoir chamber is closed or not by a stopper or the like such as pump piston which is primarily separate from a piston rod and then connected thereto. Even positive prevention of actuation may be accidentally released e.g. by mutual rotary motion of the two dispenser units.

OBJECTS OF THE INVENTION

An object of the invention is to provide a dispenser avoiding the disadvantages of prior art designs or of the kind as described above. A further object is to ensure reliable enclosure of the medium during its shelflife by closing off the reservoir chamber or by preventing accidental actuation. Another object is to alert a user concerning any prior use or operation of the dispenser. Still a further object is to achieve simple design and ease of use.

SUMMARY OF THE INVENTION

According to the invention locking means are provided which either maintain the reservoir chamber sealingly closed or prevent any relative motion thereof in a discharge mode. A movement for releasing the lock is expediently provided. In the vicinity of the locking or sealing face releasing lock motion is linear or parallel to the plane of the reservoir outlet. It may also be an arc or pivot motion. The securing or locking member can remain connected to the dispenser in its released position or can be totally removable to thus clearly signal prior use of the dispenser.

The locking member is also suitable to fixedly lock the medium reservoir to one of the dispenser units. Thus these components form a preassembled module which is then assembled to the other dispenser unit by an axial or linear motion. The locking member may be released solely by being pulled, but also by being pushed. Pushing may release a catch securing the locking member against release motions or may render a handle accessible which is initially not accessible. Thereafter, the locking member may be fully released by gripping the handle.

The reservoir may be firmly seated or movable on the corresponding unit and may be moved relative to this unit during insertion and release of the locking member or during discharge actuation.

The locking member is tensioned directly relative to the reservoir by two opposing or remote strain faces. One of these strain faces may engage the reservoir only indirectly, namely via a spacer. The strain faces then act on separate bodies which are mutually movable both in the release direction and in the tensioning direction oriented transverse thereto for straining the one relative to the other. If the strain faces are fixedly interconnected with respect to the release or tensioning direction, the spacer may be omitted and their support may be provided directly by the housing of the associated dispenser unit and by the reservoir.

The locking member is located between the reservoir outlet and the pump piston or piston rod. The piston may also be provided within the reservoir chamber as an additional closure plug which seals by radial pressure and thus not like the locking member by axial pressure. Particularly when the locking member is provided only for locking manual actuation its locking position may also be secured with respect to the associated unit by a snap connector or a nominal rupture connection. Then the locking member can be translated into the release position solely by untieing or breaking this connection on commencement of the motion of the discharge actuator.

BRIEF DESCRIPTION OF THE DRAWINGS

Example embodiments of the invention are explained in more detail in the following and illustrated in the drawings in which.

DETAILED DESCRIPTION

Figure 1:
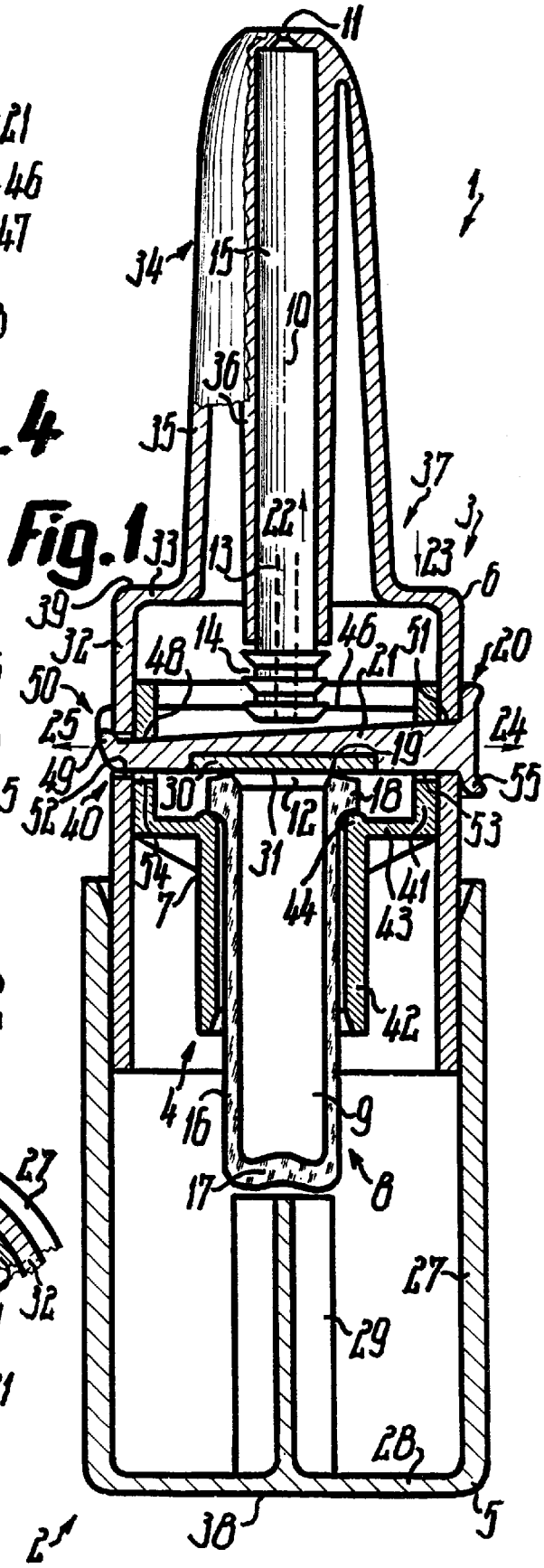
FIG. 1 is an axial section through a dispenser of the invention.
Figure 5:
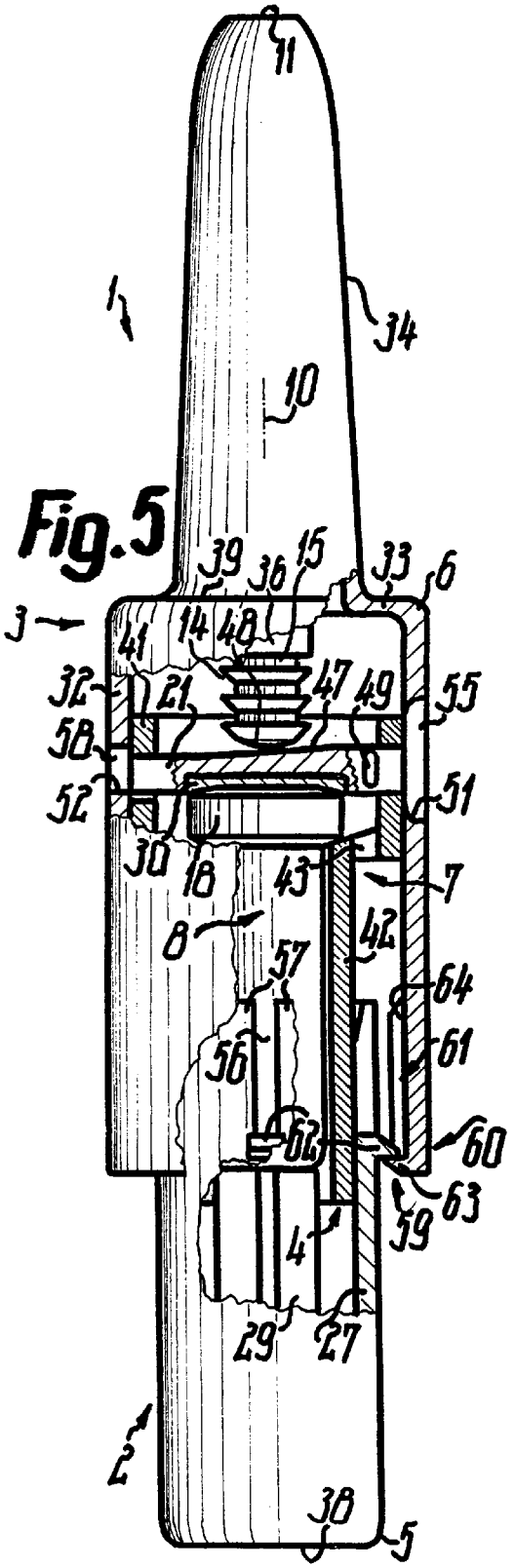
FIGS. 5+6 are further embodiments in views according to FIG. 1.

In FIGS. 1 and 5 the dispenser 1 is in its initial or rest position, namely in its state of longest extension and simultaneously in its positively locked state. The dispenser has first and second dispenser main units 2, 3 with base bodies 5, 6 and an intermediate unit 4 with a base body 7 located permanently totally within units 2, 3. As shown in FIG. 1 units 2, 3 form the outermost, freely exposed faces of the dispenser 1, while being rotatable and axially movable relative to each other. Unit 4 is locked with respect to unit 3 in the rotational direction, axially and radially without motion play. Thus units 3, 4 are movable relative to unit 2 in the cited directions. This also applies to a one-part reservoir 8 which in the locked state and with respect to units 2 to 4 is centered axially positively and radially with little motion play while being non-positively but fixedly connected as to rotational forces. Reservoir 8 has over its entire length a reservoir chamber 9 also being a pressure or pump chamber which provides over its full length a cylinder slide face for a pump, such as a thrust piston pump. All of the cited components are located in a common dispenser axis 10, to which they may be configured axially or rotationally symmetrical. Also the environmentally porting medium outlet 11 or the reservoir outlet 12 and an outlet duct 13 valvelessly connecting outlets 11, 12 is located parallel to or coaxial with axis 10. Outlet 12 and duct 13 provide an outlet path for the medium.

The pump comprises a piston 14 having at least two and maximally four serially coaxial and acutely flanked piston lips. These lips can slide with sealing pressure and be linearly in contact with the inner circumference of chamber 9, but are located contact-free outside of chamber 9 in FIG. 1. Piston 14 is provided on the end of rod-shaped plunger ram 15 made in one part with piston 14. Piston rod 15 extends from piston 14 up to the inner end of a nozzle duct forming outlet 11 and bounds duct 13 up to this nozzle duct in one part. At the inner end of the nozzle duct a flow chamber may be provided for generating a flow transverse to axis 10. This can be a mixing, swirl or twisting chamber which causes a medium swirl about axis 10 with which the medium then emerges finestly atomized from outlet 11. Outlet 11 may also be designed to release the medium dose as a non-atomized jet or as a single droplet. The inner end of duct 13 traverses the end face of piston 14.

Reservoir 8 is made of glass or a material having comparable properties such as a plastics material. Its cylindrical jacket 16 adjoins in one part the entirely closed bottom 17 and a flange 18 annularly protruding beyond its outer circumference. The free end face of flange 18 forms an annular boundary edge 19 spaced from and located between the inner and outer circumferences of jacket 16 or of flange 18. Boundary edge 19 is perpendicularly or obtusely flanked, sharp and protrudes axially the most to provide the boundary of outlet 12.

Together with body 7 the reservoir 8 is fixed as described relative to body 6 by a securing or preventing means 20 which seal chamber 9 hermetically from the exterior. Lock 20 positively prevents axial actuation of dispenser 1 or ingress of parts 14, 15 into chamber 9. For this an oblong locking or securing member 21 is radially inserted between parts 14, 15 and parts 8, 18 only into bodies 6, 7. Thus member 21 is located between piston 14 and the free end face of flange 18. On discharge the medium flows axially in direction 22 through the dispenser 1 from chamber 9 directly through piston 14, rod 15 and outlet 11 away from unit 2. This requires to displace unit 3 relative to unit 2 in the opposite direction 23. To release the lock 20 member 21 needs to be entirely pulled out of the dispenser 1 at right-angles relative to axis 10 in direction 24. In the opposite direction 25 member 21 is inserted as shown in FIG. 1 for transferred into the locking position. Member 21 may be symmetrical to an axial plane 26 of axis 10, but is asymmetrical relative to the axial plane at right-angles thereto. Thus member 21 is insertable into the dispenser 1 from one side only or by a single leading end while being removable only to this side.

The one-part base body 5 has a cylindrical shell 27, a planar bottom 28 at the rearmost shell end and an axial projecture 29 which freely protrudes from the bottom's inside with radial spacing from shell 27 and less far than shell 27. This cruciform mandrel 29 extends up to bottom 17 and has roughly the same outer width as jacket 16. Between reservoir 8 with mandrel 29 and unit 14, 15 a plate-type seal 30 is located. The planar, slightly resiliently compressible sealing face 31 is supported axially pre-stressed on boundary edge 19 where it exhibits its maximal sealing pressure. The closure and securing body 30 is fixedly connected to dimensionally rigid part 21, is made of tetrafluoroethylene or a material having similar sealing and sliding properties and is fully fillingly inserted in a recess of member 21. The securing and sliding face 31 thus connects gap- and stepfree or contionuously in direction 24 or 25 to an outermost face of member 21 which face forms a continuation of face 31. The inner circumference of the recess may fully envelope the outer circumference of seal 30. The recess may also be a transverse groove which like seal 30 extends up to the outermost side flanks of member 21. Seal 30 may be inserted as a separate part into the recess with radial pressure. Seal 30 may also be fixedly connected to the material of member 21 by molding. Seal 30 may also be coated or compounded on member 21.

The one-part base body 6 has a shell 32 freely protruding counter shell 27 and only in direction 23 from an annular end wall 33. Body 6 also has a stud 34 freely protruding in the opposite direction 22. The free end wall of stud 34 is traversed by outlet 11 and bounds the nozzle duct in one part. The end face of rod 15 supports against the inside of this end wall. The smallest width of the nozzle duct or of outlet 11 is maximally one or half a millimeter. Stud 34 has an outermost shell 35 protruding only in direction 22 from planar wall 33. Shell 35 is acutely or conically tapered over its entire length. This constriction is continuous in connection to wall 33 and progressive in the transition to the end face traversed by outlet 11. Radially spaced from and within shell 35 the stud 34 has an inner shell 36 adjoining the end wall of stud 34 in one part and protruding in direction 23 freely beyond the inside of wall 33. Unit 14, 15 is inserted into this inner end in direction 22. Thus the outer circumference of rod 15 supports against the inner circumference of shell 36 with radial pressure and piston 14 is axially slightly spaced from the inner end of shell 36. The outer width of the piston 14 is slightly larger than that of shell 36. The outer circumference of shell 32 is slidingly in close contact with the inner circumference of shell 27. Shell 27 may define the radially largest extension of the dispenser 1 and may almost entirely accommodate shell 32.

Units 2, 3 form a manual discharge actuator 37 including two remote pressure handles 38, 39 which are located at the rearmost end of the dispenser 1 respective of stud 34. Handle 38 is formed by the outside of end wall 28. Annular handle 39 surrounds stud 34 or protrudes only at two remote sides of stud 34 while being formed by the outside of the wall 33. Wall 33 protrudes only beyond the outer circumference of shell 35 or the inner circumference of shell 32.

Figure 2:
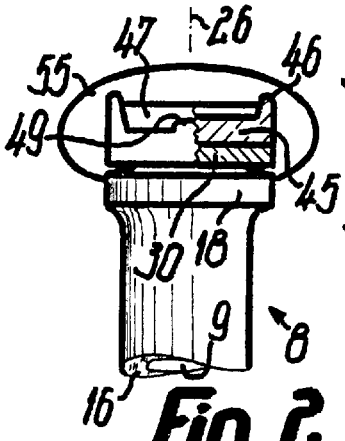
FIG. 2 is a partial length section through a detail of FIG. 1.

A guide 40 receives locking member 21 and is provided in shell 32 and body 7. Guide 40 envelopes member 21 in section as shown in FIG. 2 over the complete circumference closely or so sealingly that no dirt is able to ingress from without into the housing formed by bodies 5 6. This housing is formed by the two cap bodies 27, 28 and 32, 33 and accommodates body 7 fully as well as the majority of the member 21 fully enveloped. The one-part body 7 has a widest shell 41 freely protruding in direction 22, a less wider and longer shell 42 adjoining shell 41 in direction 23 and an end wall 43 interconnecting shells 41, 42. The outside of wall 43 may be supported with respect to the outer circumference of shell 42 by circumferentially distributed ribs. An annular support member 44 or a bead protrudes slightly beyond the inside of wall 43, forms a continuation of shell 42 and positively supports reservoir 8 on the transition shoulder between shell 16 and flange 18. Projecture 41 slides with its outer circumference on the inner circumference of shell 32, is axially spaced (FIG. 1) from a stop formed by the inner face of wall 33, surrounds piston 14, and is radially spaced from reservoir 8, from flange 18 as well as from seal 30. Projecture 42 surrounds shell 16 with a minor or zero radial clearance only over part of the reservoir length, protrudes in direction 23 less far than shell 32 and is radially entirely spaced from shells 27, 32. Thus body 7 is permanently totally located within cap 32, 33 of body 6. As compared to this reservoir 8 freely protrudes in direction 23 beyond bodies 6, 7 into body 5 by its bottom end which juts from shell 42 and extends up to the end face of mandrel 29.

Reservoir 8, which like bodies 5 to 7 is dimensionally rigid, is axially stressed directly relative to body 7 with member 21 and is secured relative to body 6 without motion play. The stressing forces act thereby only on the remote end faces of flange 18. In cross-section perpendicular to directions 24, 25 member 21 has an acutely bevelled plate 45 with a planar wedge face which faces outlet 12 while being oriented at right-angles to axis 10 and located in the plane of face 31. The remote planar pitch or wedge face 47 approaches in direction 25 the first-mentioned wedge face at an acute angle of a few degrees. The middle part 45 adjoins on both sides legs 46 to provide a U-profile. Legs 46 protrude only in direction 22 and continuously cover the majority of the length of member 21. Legs 46 have edge faces oriented over their length parallel to direction 24 or 25 and thus having a height increasing in direction 25. Legs 46 stiffen member 21 and plate 45. Guide 40 has breakthroughs or openings 51, 52 in two limited circumferential and opposite sections of shell 32. Guide 40 has also openings or breakthroughs 53, 54 in corresponding sections of shell 41. Openings 51 to 54 are aligned. The bounds of the openings are closely adapted to the outer contour of member 21 and are thus also U-shaped. Thus each opening has a shape or size differing from those of all remaining openings.

Figure 3:
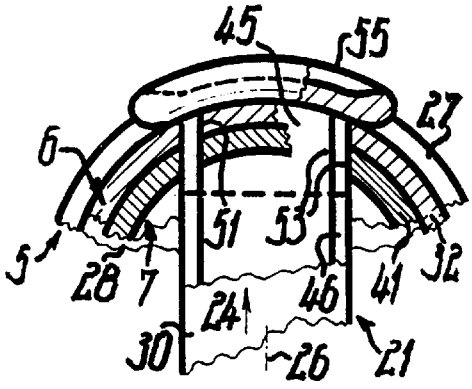
FIG. 3 is a cross-section of FIG. 1.

When positioned member 21 is positively locked against motions in direction 24 or 25 by a lock 50 without motion play relative to bodies 6, 7. To prevent motions in release direction 24 member 21 has at one end a locking or snap member 49, namely a cam protruding beyond the locking face 47. Cam 49 is spaced from and located between legs 46. In locking position this cam supports between legs 46 on an outer face of shell 32 which is remote from the inner circumference. To prevent motions in direction 25 member 21 has at its other end a stop or handle 55 which supports opposite to cam 49 on a corresponding circumferential face of shell 32. The largest distance of the plate or cup member 49 or 55 from axis 10 may be maximally as large as the corresponding maximal distance of body 5 or shell 27 so that the protruding parts do not hinder. Members 49, 55 may be curved about axis 10 (FIG. 3). Members 45, 46, 49, 55 are in one part. Webs 46 adjoin handle 55.

Piston 14 juts between stiffeners 46 and is directly juxtaposed with face 47. A counterface 48 for face 47 is a corresponding wedge or sliding face on body 7. Face 48 is formed by those sections of openings 53, 54 which are nearest to outlet 11. Thus member 21 not only prevents mutual motion of parts 6, 7, 14, 15, but can also positively limit the mutual axial stroke of parts 5 to 8 and 14, namely by abutting mandrel 29 or the free end of shell 27 on member 21 when member 55 is in the motion path of this free end. Opening 51 may receive that section of member 21 without axial motion play, which directly connects to member 55. Opening 51 thus receives this section self-lockingly and firmly seated like a shallow wedge key.

To release the dispenser lock 20 the dispenser is manually gripped between handle 55 and shell 32 and member 21 is entirely pulled out of the dispenser 1 in direction 24. Thereby face 31 and then the adjoining face of member 21 slides along the boundry edge 19 of the free end face of flange 18. Thus, on commencement of this motion the axial pressure of face 31 is loosened or eliminated to thus release the catch 50. Then, by manually mutually approaching handles 38, 39 the pumping stroke may be implemented. Thereby, mandrel 29 drives reservoir 8 together with or independent from body 7 in direction 22 relative to unit 3. Thus, piston parts 14, 15 enter the conically flared outlet 12 to again seal it tightly except for duct 13. In the further stroke course the medium stored in chamber 9 is pressurized and discharged through duct 13 from outlet 11 where the medium detaches from the dispenser 1. Piston 14 thereby reaches bottom 17. If the body 7 is thereby codriven, the free end of its shell 41 abuts after a stroke portion on a counterstop, namely the inner face of wall 33. When the member 21 is inserted in direction 25, body 7 executes with body 8 an axial tensioning motion relative to body 6. Body 6 may be preassembled with each of parts 7, 8, 14, 15, 21, 30 before being assembled with the one-part unit 2.

Figure 4:
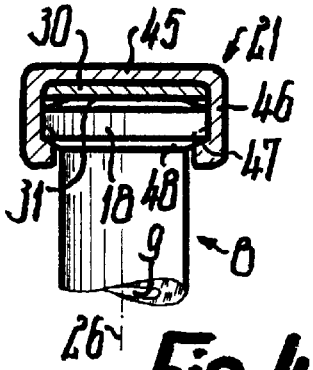
FIG. 4 is a further embodiment in a view according to FIG. 2.

Parts 7, 8 may also be in one part commonly. In FIG. 4 member 21 is tensioned without spacer 7 directly relative to reservoir 8 since member 21 simultaneously contacts the two remote end faces of flange 18 with axial tension. In this case legs 46 protrude beyond plate 45 only in direction 23 and have at their ends projectures directed toward plane 26. These projectures form the wedge faces 47 which face the face 31. Faces 47 support linearly and prestressed on counterface 48 of reservoir 8. The obtuse conical face 48 is formed by the transition between jacket 16 and flange 18. Face 48 is remote from the free end face of flange 18. Seal 30 is provided on the inside of the planar connecting section 45 and extends up to the inner faces of legs 46 which may slide or be guided between boundary edge 19 and face 48 on the cylindrical outer circumference of flange 18. Members 8, 21 may be preassembled before then being assembled with unit 3 or body 6. Thus chamber 9 may be sealingly closed by member 21 directly after the medium has been filled in. On the pump stroke mandrel 29 pushes reservoir 8 beyond wall 33 between shells 35, 36. Thereby reservoir 8 can enter shell 42.

In FIG. 5 the connection or end wall between shells 41, 42 is formed by radial ribs 43 uniformly distributed about axis 10. Between ribs 43 axial through-openings are formed which directly adjoining the opposite inner and outer circumferences of shells 41, 42. The free end of shell 27 forms circumferentially distributed and axial projectures 57 which are adapted to pass the openings of the rib wall 43. Projectures 57 are separated by breakthroughs 56 or slots. Shell 32 clasps the outer circumference of shell 27. Thus shell 27 or body 5 may be entirely pushed into cap 32, 33 while permanently sliding on the outer circumference of shell 42. After the first partial stroke projectures 57 enter the openings in end wall 43 until the bottom or end faces of slots 56 abut against wall 43 to then drive body 7 until it abuts on wall 33. Thereby projectures 57 do not protrude beyond the free end of shell 41. Once the protuberances 57 have entered the openings in body 7 a positive rotation prevention free of motion play is achieved between parts 5, 7. Thereby projectures 57 also slide on the inner circumference of shell 41.

Locking member 21 is braced directly relative to body 6 or piston unit 13, 14 because the free end of piston 14 forms the counter face 48 in contact with the tension face 47. Thus, the counter member for catch member 49 may be formed by the inner circumference of shell 41 or 32, e.g. when member 49 is located between the axis 10 and member 55. In this case handle 55 is totally countersunk in shell 32 or in opening 51. Handle 55 does not protrude beyond the outer circumference of shell 32. At the other end member 21 has a pressure member 58 which similar to handle 55 is widened with respect to the intermediate section 45, 46. Button 58 is likewise entirely countersunk in shell 32 or in opening 52.

Members 55, 58 form a smooth continuation of the outer circumference of shell 32. To release member 21 the button 58 first needs to be pushed until member 21 is displaced sufficiently so that handle 55 protrudes far enough out of shell 32 to permit manual gripping. Member 58 could also be formed by a part separate from member 21 or could be connected thereto via a nominal rupture connection. Thus member 58 could remain on body 6 without needing to be moved inbetween reservoir 8 and piston 14 when member 21 is released.

Bodies 5, 6 may also be directly interlocked by a lock 60. Thereof a withdrawal preventor 59 prevents bodies 5, 6 from being axially pulled apart in the rest position. A rotational lock 61 prevents mutual rotation of bodies 5, 6 in any position or until the rotational lock is effective between bodies 5, 7. A corresponding lock may also be provided directly between bodies 6, 7. Means 60 have cams 62 on body 5 and circumferentially distributed about axis 10. Cams 62 protrude radially outwards from the outer circumference of shell 27 and adjoin the bottom faces of openings 56. Counter cams 63 cooperate with cams 62 and protrude beyond the inner circumference of the shell 32 and are located at the free end thereof. Cams 62, 63 form a snap connector by sliding on each other with inclined ramps when assembling unit 2 with body 6. Thereby cams 62, 63 radially deflect from each other under resilient deformation of bodies 5, 6 whereafter they snap back behind each other to positively prevent mutual withdrawal of units 2, 3. Cams 62 may also be provided for the rotational lock 61 when they engage length grooves of the inner circumference of shell 32.

Figures 6, 7, 8:
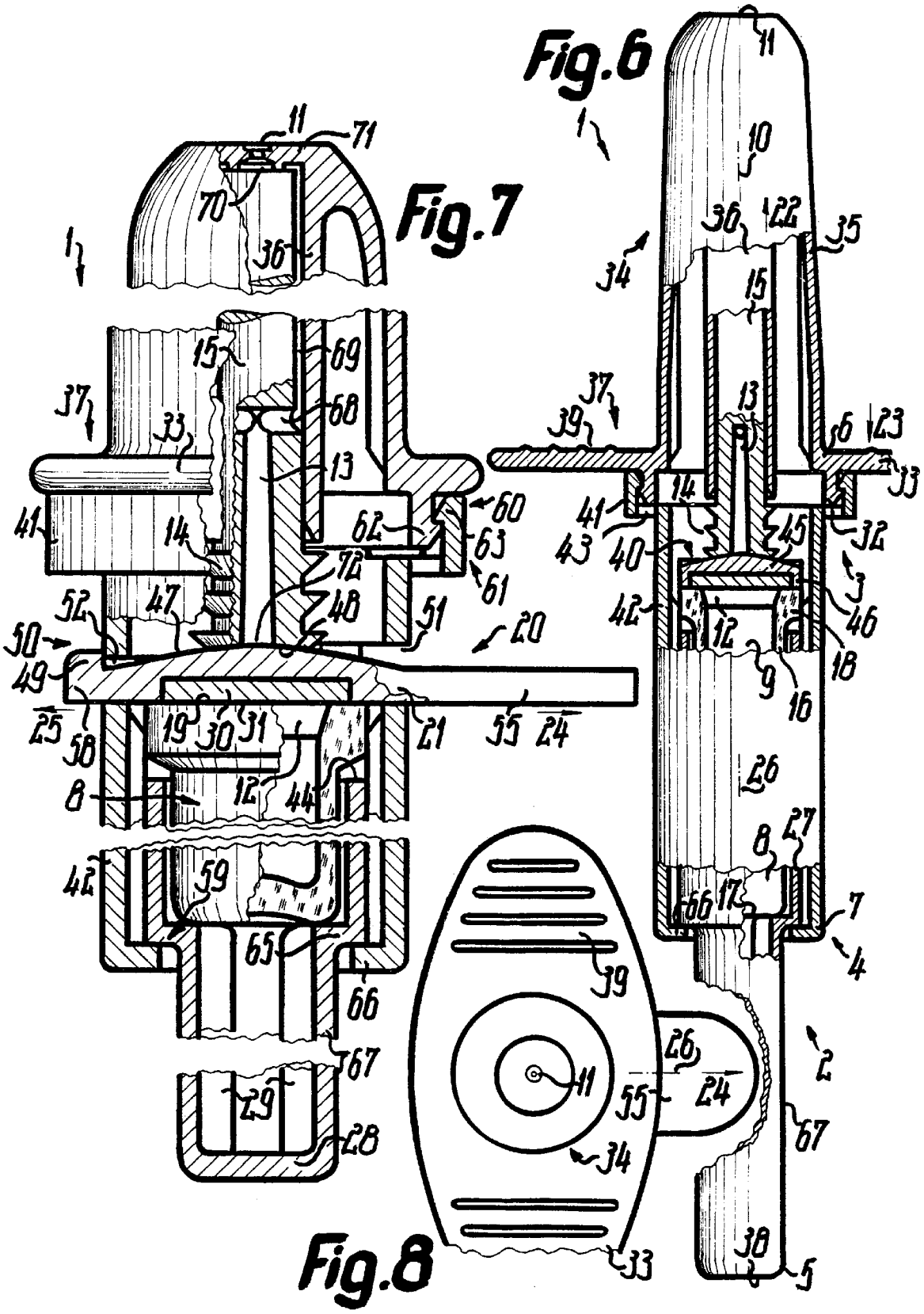
FIG. 7 is an enlarged axial section through FIG. 6.
FIG. 8 is a plan view of FIG. 7 on the scale of FIG. 6.

In FIGS. 6 to 8 bodies 6, 7 are permanently fixedly interconnected with respect to axial or rotary motions. Thus bodies 6, 7 form equally long length sections of unit 3. These sections are fixedly interconnected by lock 60. Shell 32 juts into shell 41 and is connected thereto by snap members 62, 63. Shell 41 extends up to the inside of wall 33. Shell 32 extends up to the inside of wall 43 formed by radial ribs. In axial view wall 33 is oblong or oval and protrudes varyingly far over the entire circumference of shells 32, 41. Wall 33 forms only on remote sides of stud 34 two opposing pressure faces 39 which are located in the axial plane oriented at right-angles to plane 26. In axial view faces 39 and projection or foot 55 form a T. The length of shells 32, 41 is smaller than their diameter or half or a quarter thereof. Thus reservoir 8 is totally located within body 7 and does not jut into body 6 in the rest position.

Thus bodies 5, 7 and lock 20 commonly form a preassembled unit which merely requires to be connected to body 6 via lock 60. Body 5 has a sleeve-shaped section or shell 27 fully located in body 7 and receiving reservoir 8. Shell 16 is centered in shell 27 with radial motion play. Flange 18 has slight axial distance from end face 44 and is located outside of shell 27. Shell 27 transits via an annular end wall 65 into a slimmer, sleeve-shaped section 67. Section 67 is freely exposed in the rest position and protrudes out of body 7 in direction 23 by the dimension of the working stroke or by the spacing between the mutually opposing end faces of piston 14 and bottom 17. Body 7 forms at its upstream end an annular end wall 66 protruding beyond its inner circumference. Section 67 protrudes out of wall 66. Wall 66 positively prevents body 5 from being withdrawn from body 7 by abutting against wall 65. Wall 65 is located between walls 17, 66 which contact wall 65 in the rest position. Wall 65 transfers the actuating pressure directly to bottom 17.

Lock 20 axially braces wall 17 against wall 65 and wall 65 against wall 66. Thereby also unit 14, 15 is tensioned against the end wall 71 of stud 34 and member 62 is tensioned against member 63. Member 41, 63 may also be formed by separate, for example four, axial projectures which are interspacedly distributed about axis 10. These projectures are symmetrical to plane 26 and bound window openings between them. Shells 18, 27 are slidingly guided on longitudinal edges of axial ribs which protrude in one part from the inner circumferences of shells 42 and 35. Corresponding ribs 29 are also provided on the inner circumference of shell 67, the bottom 28 of which forms handle 38.

Member 21 or its guide 40 is provided only on body 7 and not on body 6. Piston 14 and shell 36 protrude in direction 23 into shell 41 or 42. Thus piston 14 protrudes beyond the remaining body 6, namely shell 32. The tensioning or wedge face 47 has varying pitches, namely the minimal pitch at the portion adjoining face 48 in the locked position. Face 48 is formed by a spherical cap recess on the free end face of piston 14 to which the spherical cap projection 47 is adapted. The two faces 47, 48 thus form a resiliently releasable snap connector of means 50. Thus member 49 could be omitted. From engagement with face 48 the face 47 declines in both directions 24, 25 as well as transverse thereto down to legs 46.

Duct 13 extends as a blind hole from face 48 over only a minor portion of the length of shaft 15 into shell 36 and connects at its bottom to transverse duct 68 directed against the inner circumference of shell 36. This inner circumference and the outer circumference of shaft 15 bound axial ducts 69 laterally displaced relative to the axis 10 and duct 13. One of the transverse ducts 68 connects to the upstream end of each of ducts 69. The downstream ends of ducts 69 extend down to the associated end of shaft 15. Ducts 69 may be formed by longitudinal grooves in shaft 15 and port into the swirl or vortex means 70. The duct recesses of means 70 are only provided in the inside of end wall 71. The cross-section of ducts 69 is significantly smaller than that of ducts 13, 68.

The opening 72 of duct 13 which traverses face 48 is closed pressure-tightly by face 47. Thus a manually actuatable valve is formed and contamination of outlet duct 13, 68, 69, 70 during the shelf-life is prevented. In FIG. 1 cam 49 protrudes partly beyond one of the plate faces, namely wedge face 47; in FIG. 5 cam 49 protrudes laterally beyond the outsides of the middle section of member 21; in FIG. 7 cam 40 protrudes only beyond the lowest part but not beyond the highest part of face 47. In FIG. 4 snap locking could be omitted due to the self-locking effect, but here too, direct snap-locking of reservoir 8 is possible.

Boundary surface 19 in this case is planar throughout from outlet 12 up to the outer circumference of reservoir 8. Member 21 has a recess which is bounded about its entire circumference and receives seal 30. Thus on both sides of plane 26 the narrow legs 46 and on both sides of the associated perpendicular axial plane the projectures 55, 58 are formed. As a plate or button handle 55 juts from wall 33 and shell 41 by a degree which amounts to maximally half the coparallel and narrower extension of wall 33. Thus handle 55 is spaced from the outer circumference of bodies 5 to 7. Parts 8, 30 could also be commonly made of the same material or in one part.

Guide 40 or its openings 51, 52 are exclusively provided in shell 42. For assembling, reservoir 8 may be first inserted into body 5 in direction 23 and then codirectionally inserted together therewith into body 7. After this, member 21 is inserted in direction 25. The resulting assembly unit may then be attached to body 6 in direction 23, whereby firstly faces 47, 48 come into mutual engagement and the axial preventing pressure is built up. It is also possible that only bodies 5, 7, 8 are attached to body 6 as a preassembled unit, after which member 21 is inserted. The opening motion of member 21 may also be a rotary motion about axis 10 respective about an eccentric axis or a motion transverse to plane 26. Furthermore, the seal may contact the inner circumference of outlet 12 exclusively or in addition thereto with radial pressure to thus form the snap connector locking member 21. Seal 30 or face 31 may contain germicidal substances, admixed in the material thereof.

The described functions are given irrespective of the rotational position of reservoir 8 relative to bodies 5 to 7, 21. Since reservoir 8 is slidingly guided via body 7 on body 6 or directly on body 6, highly reliable functioning is assured during actuation. It will be appreciated that all features of all embodiments are interchangeable or supplementary to each other. The cited properties and effects may be provided precisely as described, or merely substantially or approximately so and may also greatly deviate therefrom depending on the particular requirements.

What is claimed is:

1. A dispenser for discharging media comprising:

a discharge actuator (37) including a first main unit (2) and a second main unit (3) manually displaceable with respect to said first main unit (2) in an actuating direction (23);

an outlet path ending in a medium outlet (11) where the medium is released from said dispenser (1), a reservoir (8) including a reservoir chamber (9) with a reservoir outlet (12) located upstream of said medium outlet (11); said outlet path including said reservoir outlet (12) and an outlet duct (13) downstream of said reservoir outlet, said reservoir outlet (12) being bounded by a boundary edge (19) of a free end face of a flange (18);

means (20) for preventing flow of the media toward said medium outlet (11) and including a securing member (21), and means for releasing said preventing means (20) independent from said discharge actuator (37) and prior to said flow by displacing said securing member (21) with respect to at least one of said first and second main units (2,3), said securing member being displaced from a locking position and being displaced in a releasing direction (24), said dispenser (1) defining a dispenser axis (10), wherein said securing member (21) directly blocks said outlet path when said securing member (21) is in said locking position.

2. The dispenser according to claim 1, wherein said securing member (21) is a slider including a closing face (31) axially urged against said boundary edge (19) of said reservoir outlet (12) with an urging stress by tensioning means, said releasing direction (24) being oriented transverse to said dispenser axis (10), said securing member (21) closing said reservoir outlet (12).

3. The dispenser according to claim 2, wherein means are included for substantially continuously varying said urging stress by displacing said securing member (21) with respect to said boundary edge (19).

4. The dispenser according to claim 1, wherein said actuating direction (23) and said dispenser axis (10) are substantially parallel, said securing member (21) being located in an axial plane (26) of said dispenser axis (10), said second main unit (3) including a guide (40) displaceably mounting said securing member (21), said securing member (21) internally traversing said second main unit (3) and including a release handle (55) for pulling said securing member (21) out of said second main unit (3) in said releasing direction.

5. The dispenser according to claim 1, wherein a pitch face (47) is included for displacing said securing member (21), said releasing direction (24) crossing said dispenser axis (10), said pitch face (47) variably tensioning said reservoir (8) with respect to said second main unit (3).

6. The dispenser according to claim 5, wherein said pitch face (47) is substantially linear and ascends acutely self-locking, said pitch face including a wedge face (47).

7. The dispenser according to claim 5, wherein said pitch face (47) is located at a pitch side of said securing member (21), said pitch side being remote from said boundary edge (19).

8. The dispenser according to claim 1, wherein said boundary edge (19) is simultaneously displaceable with respect to said first and second main units (2, 3) by displacing said securing member (21).

9. The dispenser according to claim 1 and further including a reservoir support (4) separate from said first and second main units (2) and positionally holding said reservoir (8), wherein said securing member (21) is displaceable with respect to said reservoir support (4), said reservoir support (4) extending inside said second main unit (3) and being displaceable relative to at least one of said first and second main units (2, 3).

10. The dispenser according to claim 9, wherein said reservoir support (4) substantially exclusively supports said securing member (21) against said urging stress, said reservoir support (4) being displaceable relative to said second main unit (3) when said securing member (21) is released.

11. The dispenser according to claim 1 and further including a lock (50), wherein said lock (50) positionally positively holds said securing member (21) with respect to at least one of said boundary edge (19)), said first main unit (2), and said second main unit (3), said securing member (21) internally traversing said second main unit (3) including said medium outler (11).

12. The dispenser according to claim 1 and further including a catch (50), wherein said catch (50) releasably prevents said securing member (21) from being displaced in said releasing direction (24), said catch (50) being releasably overcomeable by a manual release force oriented linearly and parallel to said release direction (24), said release direction being oriented transverse to said dispenser axis (10).

13. The dispenser according to claim 1, wherein a snap connector (50) is included and positionally holds said securing member (21), said snap connector (50) including a snap member (49) on said securing member (21), said snap member (49) resiliently engaging a counter member of said second main unit (3).

14. The dispenser according to claim 1, wherein said preventing means (20) include a sealing face (31) resiliently displaceable substantially parallel to said dispenser axis (10), said sealing face (31) directly blocking said outlet path upstream of said medium outlet (11), said sealing face (31) positively connecting to at least one release handle (55, 58) for manually directly releasing said securing member (21).

15. The dispenser according to claim 1, wherein said securing member (21) includes a rigid base and an elastomeric member (30) directly connecting to said rigid base and directly closing said outlet path, said release direction (24) being oriented transverse to said dispenser axis (10).

16. The dispenser according to claim 15, wherein said rigid base and said elastomeric member (30) commonly include a slide face (31), said rigid base and said elastomeric member (30) being commonly displaceable in said release direction (24), said elastomeric member (30) sealingly closing said outlet path.

17. The dispenser according to claim 1, wherein said discharge actuator (37) includes a first pressure handle (38) on said first main unit (2) and a second pressure handle (39) on said second main unit (3), a release handle (55, 58) being included for releasing said preventing means (20), said release handle (55, 58) being actuable independent from said first and second pressure handle (38, 39), said second main unit (3) and said securing member (21) commonly providing a preassembled unit separate from said first main unit (2), said second main unit (3) including said medium outlet (11).

18. The dispenser according to claim 1, wherein said securing member (21) includes a release handle (55, 58) for releasing said preventing means (20), said dispenser (1) including an outer circumference where said release handle (55, 58) is freely accessible, said discharge actuator (37) including actuating handles (38, 39), said release handle (55, 58) being located between said actuating handles (38, 39), said securing member (29) extending inside said second main unit (3) including said medium outlet (11), said second main unit (3) and said discharge actuator (37) commonly including one of said actuating handles (39) separate from said first main unit (2).

19. The dispenser according to claim 1, wherein said first main unit (2) axially supports said reservoir (8) while discharging the media, said second main unit (3) including said media outlet (11) and a media displacer (14, 15, 36) for impelling the media past said reservoir outlet (12).

20. The dispenser according to claim 19, wherein said securing member (21) is located between said reservoir outlet (12) and said media displacer (14, 15, 36), while sealingly directly connecting to at least one of said boundary edge (19), and said media displacer (14, 15, 36).

21. The dispenser according to claim 1, wherein said securing member is positionally fixed on said second main unit (3) independent from said first main unit (2), said second main unit (3) including said medium outlet (11).

22. The dispenser according to claim 1, wherein said second main unit (3), said reservoir (8) and a reservoir support (4) commonly provide a preassembled unit independent from said first main unit (2), said second main unit including said medium outlet (11).

23. The dispenser according to claim 1, wherein a locking (20) is included and releasably prevents said reservoir (8) from being withdrawn from said second main unit (3), said locking (20) including a locking member manually displaceable relative to said second main unit (3) transverse to said dispenser axis (10) for releasing said locking (20).

24. The dispenser according to claim 1, wherein said securing member (21) substantially sealingly closes said outlet duct.

25. The dispenser according to claim 1, wherein a snap member (47) is provided for postionally holding said securing member (21), said snap member (47) being located substantially in said dispenser axis (10).

26. The dispenser according to claim 1, wherein said reservoir (8) includes only a single one of said reservoir chamber (9) providing a pressure chamber, while discharging the media said medium outlet (11) and said reservoir chamber (9) being substantially coaxial, said securing member (21) sealingly closing said reservoir outlet (12), said releasing direction (24) being oriented transverse to said dispenser axis (10).

27. The dispenser according to claim 1, wherein said preventing means (20) include releasably interengaged securing faces (19, 31) on said securing member (21) and said reservoir (8), said securing faces (19, 31) including at least one of plastics material defining material characteristic substantially equal to tetrafluorethylene, and glass.

28. The dispenser according to claim 1, wherein said second main unit (3) is assembled from a first housing body (6) and a second housing body (7), said first housing body (6) including said medium outlet (11) and said second housing body (7) shielding said reservoir (8) in a rest position, said first and second housing bodies (6, 7) forming separate length sections, said discharge actuator (37) and said first main unit (2) commonly including a mandrel (67), said mandrel (67) protruding upstream out of said separate length sections and serving for manually actuating said dispenser (1).

29. A dispenser for discharging media comprising:

a discharge actuator (37) including a first main unit (2) and a second main unit (3) manually displaceable with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a means (20) for preventing flow of the media toward said medium outlet (11) and including a securing member (21), and means for releasing said means (20) for preventing independent from said discharge actuator (37) and prior to said flow by displacing said securing member (21) with respect to at least one of said first and second main units (2, 3) from a locking position in a releasing direction (24), said dispenser (1) defining a dispenser axis (10) oriented substantially parallel to said actuating direction (23), wherein said securing member (21) is tensionally supported against opposed counter faces with an urging stress, said urging stress being continuously variable by displacing said securing member (21) with respect to said opposed counter faces while said securing member remains in said locking position.

30. A dispenser for discharging media comprising:

a discharge actuator (37) including a first main unit (2) and a second main unit (3) manually displace able with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (1l), said reservoir outlet (12) being bounded by a boundary edge (19);

means (20) for preventing flow of the media toward said medium outlet (11) and including a securing member (21), and means for releasing said preventing means (20) independent from said discharge actuator (37) and prior to said flow by displacing said securing member (21) with respect to at least one of said first and second main units (2, 3) from a locking position in a releasing direction (24), said dispenser (1) defining a dispenser is (10) oriented substantially parallel to said actuating direction (23), wherein said boundary edge (19) and said reservoir (8) are commonly simultaneously displaceable with respect to said first and second main units (2, 3) by displacing said securing member (21).

31. A dispenser for discharging media comprising:

a discharge actuator (37) including a first main unit (2) and a second main unit (3) manually displaceable with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a boundary edge (19);

means (20) for preventing flow of the media toward said medium outlet (11) and including a securing member (21), and means for releasing said preventing means (20) independent from said discharge actuator (37) and prior to said flow by displacing said securing member (21) with respect to at least one of said first and second main units (2, 3) from a locking position in a releasing direction (24), said dispenser (1) defining a dispenser axis (10) oriented substantially parallel to said actuating direction (23), wherein said securing member (21) includes a release handle (55, 58) for releasing said preventing means (20), said securing member (21) extending inside said second main unit (3) including said medium outlet (11), said second main unit (3) and said discharge actuator (37) commonly including a pressure handle (39) providing a component separate from said first main unit (2).

32. A dispenser for discharging media comprising:

a discharge actuator (37) including a first main unit (2) and a second main unit (3) manually displace able with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a boundary edge (19);

means (20) for preventing flow of the media toward said medium outlet (11) and including a securing member (21), and means for releasing said preventing means (20) independent from said discharge actuator (37) and prior to said flow by displacing said securing member (21) with respect to at least one of said first and second main units (2, 3) from a locking position in a releasing direction (24), said dispenser (1) defining a dispenser axis (10) oriented substantially parallel to said actuating direction (23), wherein said securing member (21) is positionally fixed on said second main unit (3) independent from said first main unit (2), said second main unit (3) including said medium outlet (11), a release handle (55, 58) separate from said discharge actuator (37) being included for directly manually releasing said preventing means (20) independent from actuating said discharge actuator (37).

33. A dispenser for discharging media comprising:

a discharge actuator (37) including a first main unit (2) and a second main unit (3) manually displace able with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a boundary edge (19), said dispenser (1) defining a dispenser axis (10) oriented substantially parallel to said actuating direction (23), wherein said second main unit (3), said reservoir (8) and a reservoir support (4) located outside said reservoir (8) commonly provide a preassembled unit independent from said first main unit (2) enveloping said reservoir (8), said second main unit (3) including said medium outlet (11), said reservoir support (4) and said reservoir (8) being separately axially displaceable relative to said second main unit (3).

34. A dispenser for discharging media comprising:

a discharge actuator (37) including a first main unit (2) and a second main unit (3) manually displace able with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a boundary edge (19), said dispenser (1) defining a dispenser axis (10) oriented substantially parallel to said actuating direction (23), wherein a locking (20) is included and releaseably prevents said reservoir (8) from being withdrawn from said second main unit (3), said locking (20) including a locking member separate from said first and second main units (3), said locking member being directly manually displaceable relative to said second main unit (3) transverse to said dispenser axis (10) for releasing said locking (20).

35. A dispenser for discharging media comprising:

a discharge actuator (37) including a first main unit (2) and a second main unit (3) manually displaceable with respect to said first main unit (2) in an actuating direction (23);

an outlet path ending in a medium outlet (11) where the medium is released from said dispenser (1) when said discharge actuator (37) is actuated;

a reservoir (8) including a reservoir chamber (9) with a reservoir outlet (12) located upstream of said medium outlet (11), said outlet path including said reservoir outlet (12) and an outlet duct (13) between said reservoir outlet (12) and said medium outlet (11), said reservoir outlet (12) being bounded by a boundary edge (19), said dispenser (1) defining a dispenser axis (10) oriented substantially parallel to said actuating direction (23), and wherein said second main unit (3) is assembled from a first housing body (6) and a second housing body (7), said first housing body (6) including said medium outlet (11) and said second housing body (7) externally shielding said reservoir (8) in a rest position, said first and second housing bodies (6, 7) forming separate length sections, said discharge actuator (37) and said first main unit (2) commonly including a mandrel (67), said mandrel (67) protruding upstream out of said separate length sections and serving for manually forcing the medium out of said medium outlet (11).

* * * * *

UNITED STATES PATENT AND TRADEMARK OFFICE

CERTIFICATE OF CORRECTION

PATENT NO. : 6,257,454 B1
DATED : July 10, 2001
INVENTOR(S) : Stefan Ritsche

It is certified that error appears in the above-identified patent and that said Letters Patent is hereby corrected as shown below:

Column 1,
Line 15, “serval” should be -- several --.
Line 52, “face releasing” should be -- face a releasing --.

Column 4,
Line 51, “bodies 5 6” should be -- bodies 5,6 --.

Column 5,
Line 67, “boundry” should be -- boundary --.

Column 10,
Line 40, “(19))” should be -- (19) --.
Line 42, “unit (3),” should be -- unit (3), -- (end of line 42) -- said -- (start line 43).

Column 12,
Line 59, “displace able” should be -- displaceable --.

Column 13,
Line 52, “displace able” should be -- displaceable --.

Column 14,
Lines 18 and 41, “displace able” should be -- displaceable --.

Signed and Sealed this

Twenty-sixth Day of November, 2002

*Attest:*

*Attesting Officer*

JAMES E. ROGAN
*Director of the United States Patent and Trademark Office*